US008353179B2

(12) United States Patent
Kim et al.

(10) Patent No.: US 8,353,179 B2
(45) Date of Patent: Jan. 15, 2013

(54) REFRIGERATOR

(75) Inventors: Sung-Jae Kim, Ansan-si (KR); Ill-Shin Kim, Changwon-si (KR); Seung-Hwan Oh, Gunpo-si (KR); Sang-Ho Park, Gimhae-si (KR); Nam-Gi Lee, Pohang-si (KR)

(73) Assignee: LG Electronics Inc., Seoul (KR)

( * ) Notice: Subject to any disclaimer, the term of this patent is extended or adjusted under 35 U.S.C. 154(b) by 958 days.

(21) Appl. No.: 12/377,022

(22) PCT Filed: Sep. 12, 2007

(86) PCT No.: PCT/KR2007/004412

§ 371 (c)(1),
(2), (4) Date: Feb. 10, 2009

(87) PCT Pub. No.: WO2009/035172

PCT Pub. Date: Mar. 19, 2009

(65) Prior Publication Data

US 2010/0192613 A1 Aug. 5, 2010

(51) Int. Cl.

| | |
|---|---|
| ***F25C 1/00*** | (2006.01) |
| ***F25C 5/18*** | (2006.01) |
| ***F25D 23/12*** | (2006.01) |

(52) U.S. Cl. ..... 62/347; 62/338; 62/344

(58) Field of Classification Search ..... 62/338, 62/332, 340, 347, 344; 292/197, 198, 234, 292/229, 240, 241, 242

See application file for complete search history.

(56) References Cited

U.S. PATENT DOCUMENTS

| | | | | | |
|---|---|---|---|---|---|
| 3,570,266 | A | * | 3/1971 | Alvarez et al. | 62/338 |
| 4,036,620 | A | * | 7/1977 | Benasutti et al. | 62/338 |
| 4,095,439 | A | | 6/1978 | Linstromberg | |
| 5,156,021 | A | * | 10/1992 | St-Gelais et al. | 62/382 |
| 5,992,908 | A | * | 11/1999 | Yared et al. | 292/196 |
| 2003/0151261 | A1 | * | 8/2003 | Porte et al. | 292/229 |

FOREIGN PATENT DOCUMENTS

| | | | |
|---|---|---|---|
| JP | 06-011228 | * | 1/1994 |
| JP | 1994-011228 | | 1/1994 |
| JP | H06-01228 | * | 1/1994 |
| JP | H06-011228 | * | 1/1994 |
| JP | 1999-083278 | | 3/1999 |
| JP | 2000-346509 | | 12/2000 |
| KR | 10-2005-0110209 | | 11/2005 |

OTHER PUBLICATIONS

International Search Report dated Jun. 11, 2008.

* cited by examiner

*Primary Examiner* — Frantz Jules
*Assistant Examiner* — Henry Crenshaw
(74) *Attorney, Agent, or Firm* — KED & Associates, LLP

(57) ABSTRACT

A refrigerator is provided. A water supply passage unit of the refrigerator is installed going around a freezing compartment but via an outer side of the main body. Therefore, the water supply passage unit is not frozen.

11 Claims, 10 Drawing Sheets

REFRIGERATOR

TECHNICAL FIELD

The present disclosure relates to a refrigerator.

BACKGROUND ART

Generally, a refrigerator is a home appliance that stores food at a low temperature.

The refrigerator has a freezing compartment and a refrigerating compartment. An ice making unit for making ice is installed in the refrigerator. The ice making unit is connected to a tap water source by a water supply pipe.

However, since the ice making unit makes the ice using tap water, the quality of the ice cannot meet consumer's desire. Even when the ice making unit is installed in the refrigerator, the user may not use the ice making unit if the quality of the water of an area where the refrigerator is used is not good. Therefore, when the user does not use the ice making unit, the ice making unit may become a nuisance that occupies an internal space of the refrigerator.

DISCLOSURE

Technical Problem

Embodiments provide a refrigerator that can make the high quality of ice.

Embodiments also provide a refrigerator that can prevent a water supply passage unit from being frozen.

Embodiments also provide a refrigerator that can recognize the assembly or disassembly of a water tank with or from a water supply unit when the water tank is assembled or disassembled with the water supply unit.

Technical Solution

In an embodiment, a refrigerator includes: a main body defining a freezing compartment and a refrigerating compartment; doors opening/closing the freezing and refrigerating compartments; an ice making unit that is disposed in the refreezing compartment to make ice; a water supply unit that is disposed in the refrigerating compartment to store water; and a water supply passage unit that is arranged going around the freezing compartment and connected to the water supply unit and the ice making unit.

In another embodiment, a refrigerator includes a main body defining a freezing compartment and a refrigerating compartment; doors opening/closing the freezing and refrigerating compartments; an ice making unit that is disposed in the refreezing compartment to make ice; a water supply unit including a housing detachably coupled to the refrigerating compartment, a water tank detachably coupled to the housing, and a pump pumping the water stored in the water tank; and a water supply passage unit that is arranged at an outer side of the main body and connected to the water supply unit and the ice making unit to supply the water pumped by the water supply unit to the ice making unit.

In still another embodiment, a refrigerator includes a main body defining a storage chamber; a door opening/closing the storage chamber; an ice making unit that is disposed in the storage chamber to make ice; a water supply unit that is disposed in the storage chamber to store water; and a water supply passage unit that is connected to the water supply unit and the ice making unit via an outer side of the main body.

In still yet another embodiment, a refrigerator includes an ice making unit for making ice; a water supply unit including a housing disposed in a storage chamber, a water tank that is selectively coupled to the housing, and a coupling identifying unit that is provided through the housing and the water tank to allow a user to identify a coupling state of the water tank to the housing; and a water supply passage unit that is connected to the water supply unit and the ice making unit via an outer side of the main body.

Advantageous Effects

According to the embodiments, the refrigerator can make ice having a desired quality. In addition, the freezing of the water supply passage unit can be prevented.

Furthermore, the user can recognize an accurate assembling or disassembling state of the water tank.

BEST MODE

Reference will now be made in detail to the embodiments of the present disclosure, examples of which are illustrated in the accompanying drawings. Although embodiments have been described with reference to a number of illustrative embodiments thereof, it should be understood that numerous other modifications and embodiments can be devised by those skilled in the art that will fall within the spirit and scope of the principles of this disclosure.

Figure 1:
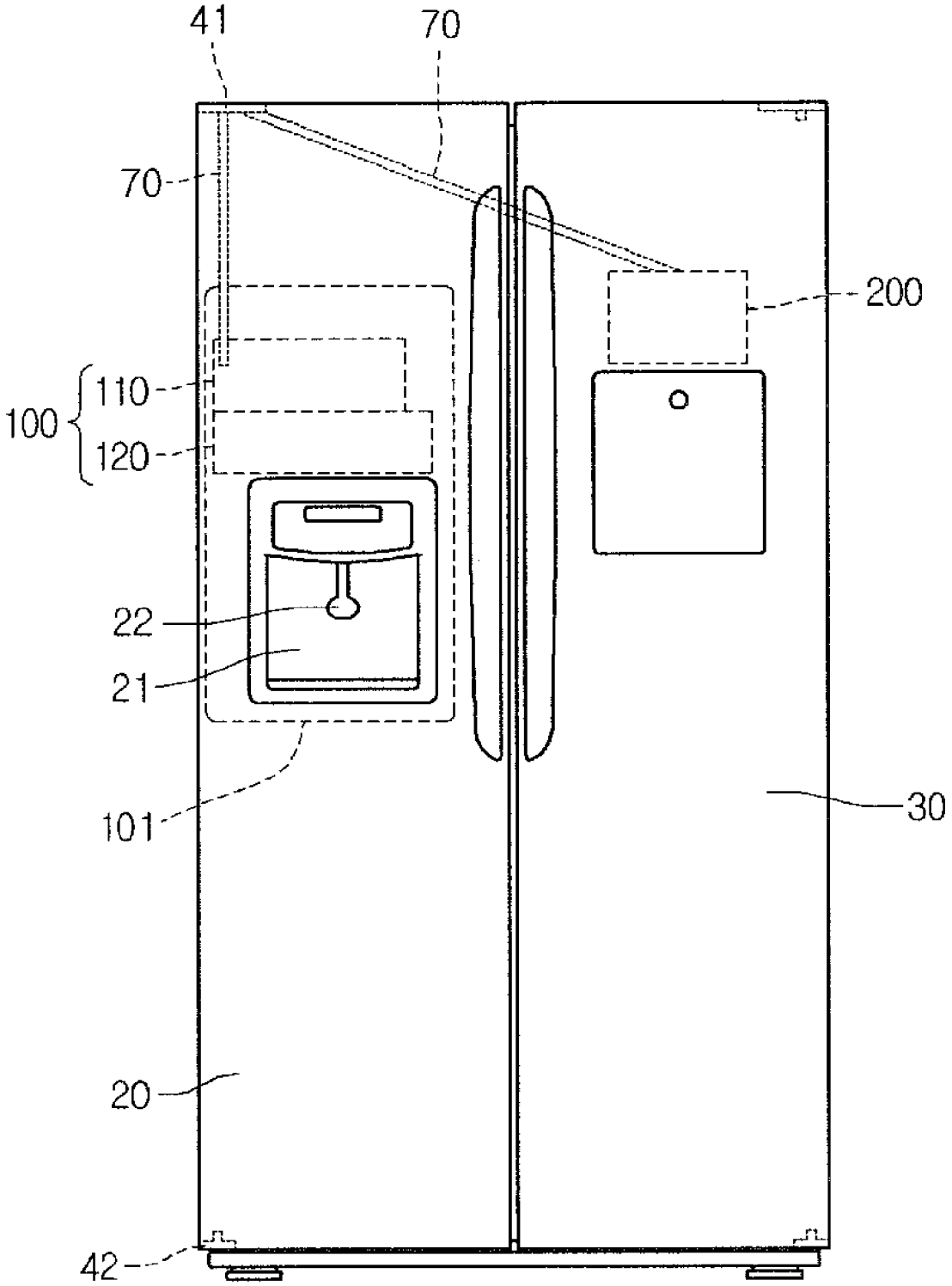
FIG. 1 is a front view of a refrigerator according to an embodiment.

FIG. 1 is a front view of a refrigerator according to an embodiment.

Referring to FIG. 1, a refrigerator includes a main body defining storage compartments. The storage compartments include a freezing compartment 11 and a refrigerating compartment 12. Doors 20 and 30 are respectively provided on front portions of the freezing and refrigerating compartments 11 and 12.

Hinge units 41 and 42 are respectively coupled to upper and lower portions of the doors 20 and 30. The hinge units 41 and 42 are installed to allow the doors 20 and 30 to pivot on the doors 20 and 30.

An ice making unit 100 for making and storing ice may be disposed in the freezing unit 11. Since the freezing compartment is defined by inner walls of the main body 10 and an inner wall of the freezing door 20, it may be understood that the door 20 of the freezing compartment 11 may be a part of the freezing compartment 11. Therefore, it can be understood that the arrangement of the ice making unit 100 in the freezing unit 100 means that the ice making unit 100 is arranged over the freezing compartment 11 and the door 20 of the freezing compartment 11. The ice making unit 100 includes an ice making unit 100. The ice making unit 100 will be described in more detail hereinbelow.

A thermal-isolation case 101 may be installed enclosing the ice making unit 100 to be isolated from the freezing compartment 11. At this point, the thermal-isolation case 101 is designed such that cool air is supplied from an evaporator (not shown) to the thermal-isolation case 101 through a passage. Therefore, the contacting of the cool air of the freezing compartment 11 with the ice after being polluted by the frozen food can be prevented. As a result, it becomes possible to make ice under sanitary conditions. A dispenser 21 is installed on the door 20 of the freezing compartment. The dispenser 21 and the ice bank 120 are interconnected by an ice discharge duct (not shown) so that the ice stored in the ice bank 120 can be discharged to the dispenser 21. At this point, the dispenser 21 may include a dispensing lever 22 so that the ice can be dispensed by pressing the dispensing lever 22.

A water dispensing unit 200 is disposed in the refrigerating compartment 12. The water dispensing unit 200 is connected to the ice making unit 100 by the water supply passage unit 70. A pump 230 for pumping out the water stored in the water dispensing unit 200 to the water supply passage unit 70 may be disposed in the water dispensing unit 200. The water dispensing unit 200 and the pump 230 will be described in more detail hereinbelow.

Figure 2:
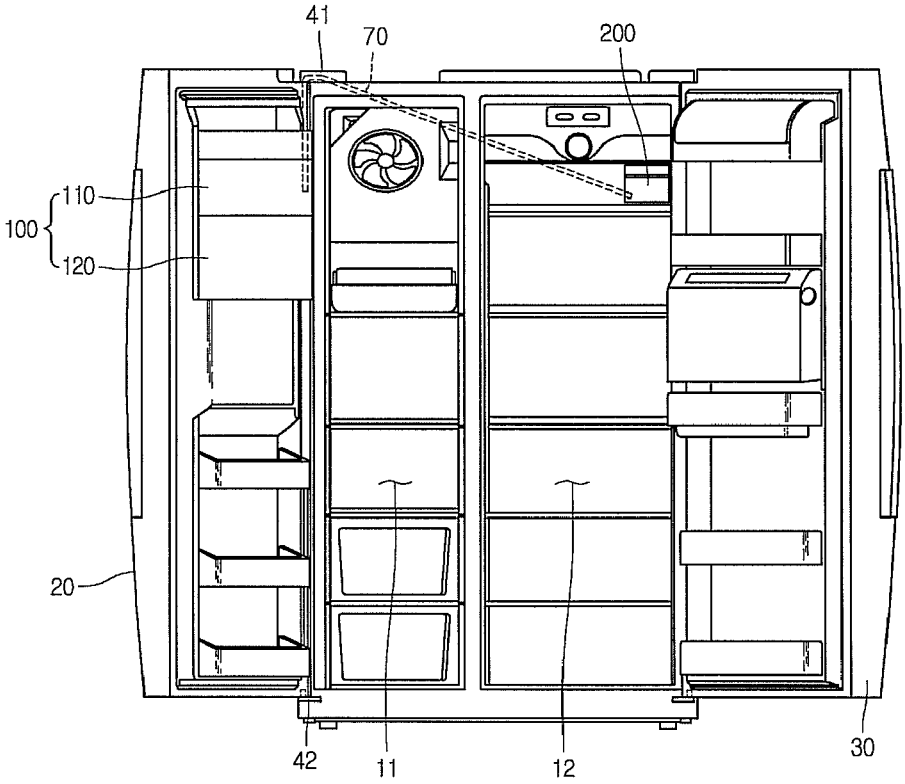
FIG. 2 is a perspective view of the refrigerator of FIG. 1, when a door is opened.
Figure 3:
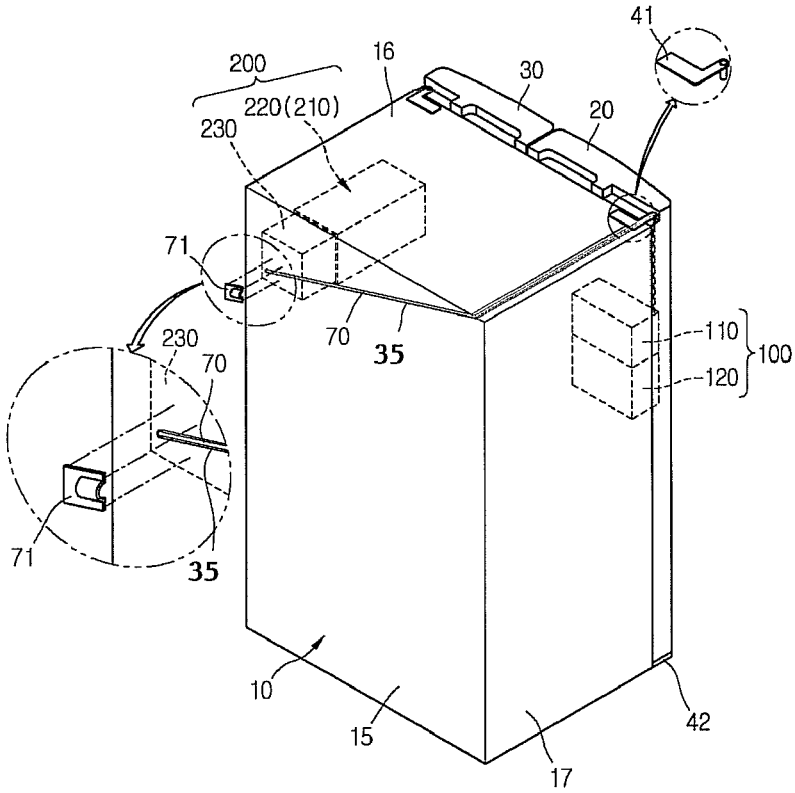
FIG. 3 is a perspective view of a structure of a water supply passage unit of the refrigerator of FIG. 1 according to an embodiment.

FIG. 2 is a perspective view of the refrigerator of FIG. 1, when the door is opened and FIG. 3 is a perspective view of a structure of the water supply passage unit of the refrigerator of FIG. 1 according to an embodiment.

Referring to FIGS. 2 and 3, the water supply passage unit 70 may be disposed going around the freezing compartment 11. When the water supply passage unit 70 is disposed via the freezing compartment 11, the water flowing along the water supply passage unit 70 is frozen. Therefore, by disposing the water supply passage unit 70 going around the freezing compartment 11, the freezing of the water flowing along the water supply passage unit 70 can be prevented. Needless to say, if the thermal-isolation member covers the water supply passage unit 70, the water supply passage unit 70 may be disposed via the freezing compartment 11.

The water supply unit 70 disposed at the outer side of the main body 10 may be connected to the ice making unit 100 via an upper hinge unit 41. The upper hinge unit 41 is provided with a hole through which the water supply passage unit 70 can pass. Therefore, since the upper hinge unit 41 is a rotational center of the door 20, the water supply passage unit 70 does not rotate together with the door 20.

Further, the water supply passage unit 70 may be buried in the door 20 for the freezing compartment so that the water supply passage unit 70 is not exposed to the external side and to the cool air of the freezing compartment 11.

The water supply passage unit 70 connected to the pump 230 penetrates a rear surface 15 of the storage chamber and is arranged extending to the rear and top surfaces 15 and 16 of the main body 10. Therefore, the length of the water supply passage unit 70 can be reduced. In addition, the water supply passage unit 70 is not exposed to the external side.

The main body 10 may be provided at the rear and top surfaces 15 and 16 with a groove 35 in which the water supply passage unit 70 seats. The groove 35 may be formed through a pressing process when the outer surface of the main body 10 is processed.

In addition, a cover 71 for covering a bent portion of the water supply passage unit 70 may be coupled to a portion of the rear surface 15, through which the water supply passage unit 70 penetrates. Further, the portion through which the water supply passage unit 70 is sealed not to leak the cool air.

In addition, a coupling (not shown) may be coupled to an externally-exposed portion and buried portion of the water supply passage unit 70. In this case, the exposed portion and the buried portion of the water supply passage unit 70 can be easily coupled to each other by the coupling. Further, the exposed portion of the water supply passage unit 70 can be easily replaced.

Figure 4:
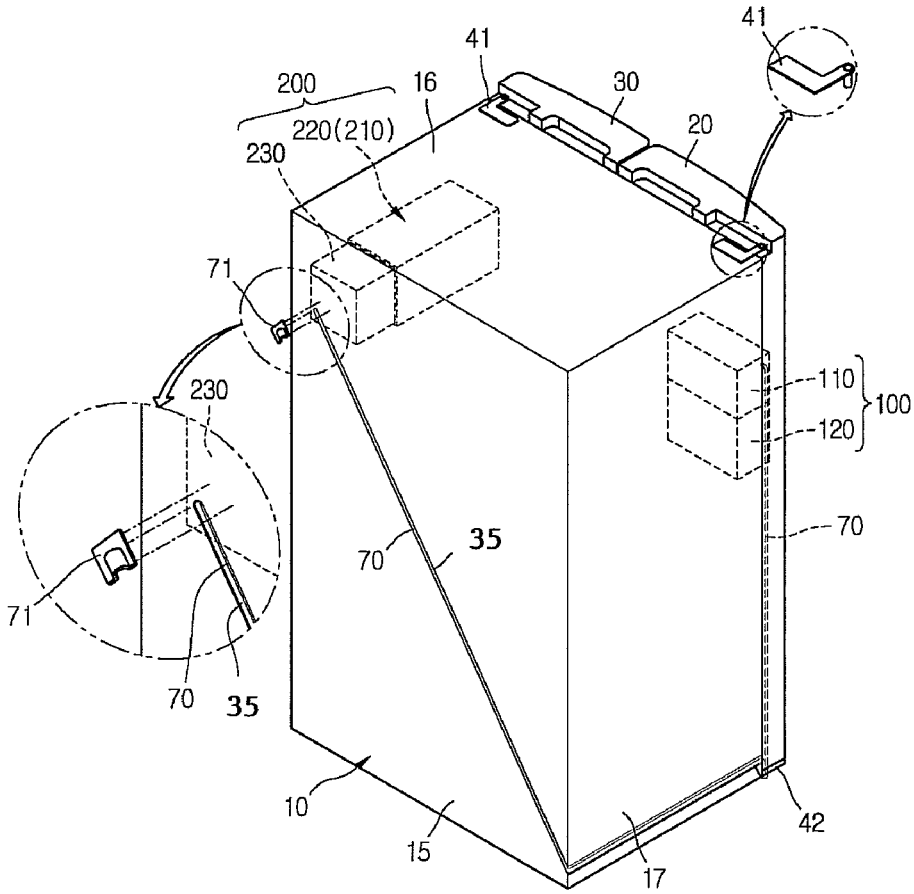
FIG. 4 is a front view of a structure of a water supply passage unit of a refrigerator of FIG. 1 according to another embodiment.

FIG. 4 is a front view of a structure of the water supply passage unit of the refrigerator of FIG. 1 according to another embodiment.

Referring to FIG. 4, the water supply passage unit 70 placed at an outer side of the main body 10 may be connected to the ice making unit 100 via a lower hinge unit 42. The lower hinge unit 42 is provided with a hole through which the water supply passage unit 70 can pass. Therefore, since the lower hinge unit 42 is a rotational center of the door 20, the water supply passage unit 70 does not rotate together with the door 20.

Further, the water supply passage unit 70 may be buried in the door 20 for the freezing compartment so that the water supply passage unit 70 is not exposed to the external side and to the cool air of the freezing compartment 11.

The water supply passage unit 70 connected to the pump 230 penetrates a rear surface 15 of the storage chamber and is arranged extending to the rear and top surfaces 15 and 16 of the main body 10. Therefore, the length of the water supply passage unit 70 can be reduced. In addition, the water supply passage unit 70 is not exposed to the external side.

The main body 10 may be provided at the rear and top surfaces 15 and 16 with a groove 35 in which the water supply passage unit 70 seats.

In addition, a cover 71 for covering a bent portion of the water supply passage unit 70 may be coupled to a portion of the rear surface 15, through which the water supply passage unit 70 penetrates. Further, the portion through which the water supply passage unit 70 is sealed not to leak the cool air.

In addition, a coupling (not shown) may be coupled to an externally-exposed portion and buried portion of the water supply passage unit 70. In this case, the exposed portion and the buried portion of the water supply passage unit 70 can be easily coupled to each other by the coupling. Further, the exposed portion of the water supply passage unit 70 can be easily replaced.

Figure 5:
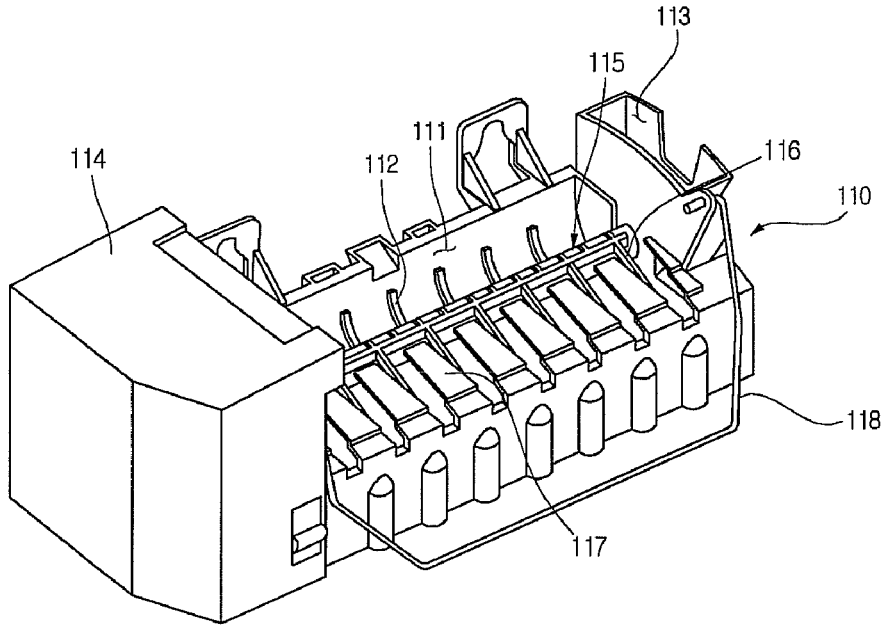
FIG. 5 is a perspective view of an icemaker of the refrigerator of FIG. 1.

FIG. 5 is a perspective view of an icemaker of the refrigerator of FIG. 1.

Referring to FIG. 5, an icemaker 110 of the ice making unit 100 defines an ice making chamber 111. A plurality of dividing ribs 112 for dividing the ice making chamber 111 into a plurality of sections is formed in the ice making chamber 111.

A water supply portion 113 to which an end of the water supply passage unit 70 is connected is formed on a side of the ice making chamber 111. A driving unit 114 is disposed on another side of the ice making chamber 111.

An ejector 115 is rotatably coupled to the driving unit 114. The ejector 115 is disposed across the ice making chamber 111. Ejector pins 116 for discharging the ice from the ice making chamber 111 is formed in the ejector 115. The ejector pins 116 are disposed between the dividing ribs 112.

A water overflowing preventing portion 117, which prevents the water from overflowing the ice making chamber 111 when the door 20 for the freezing compartment is opened and closed is formed on a side of the ice making chamber 111. The water overflowing preventing portion 117 may be inclined so that the ice can be effectively discharged by the ejector pin 116. The water overflowing preventing portion 117 may be disposed between the ejector pins 116 so that the ejector pins 116 can pass when the ejector 115 rotates.

Needless to say, the water overflowing preventing portion 117 may be provided in the form of a plate. In this case, the ejector 115 rotates in a direction to discharge the ice and further rotates in a reverse direction to return to the initial position. That is, when the ejector 115 rotates continuously in one direction, the ejector pins 115 are caught by the water overflowing preventing portion 117. Therefore, the ejector 115 rotates in a direction and subsequently rotates in an opposite direction.

An ice full detecting lever 118 is coupled to the driving unit 114 to be rotating in a vertical direction. The ice full detecting lever 118 may be disposed at a side from which the ice is discharged.

Figure 7:
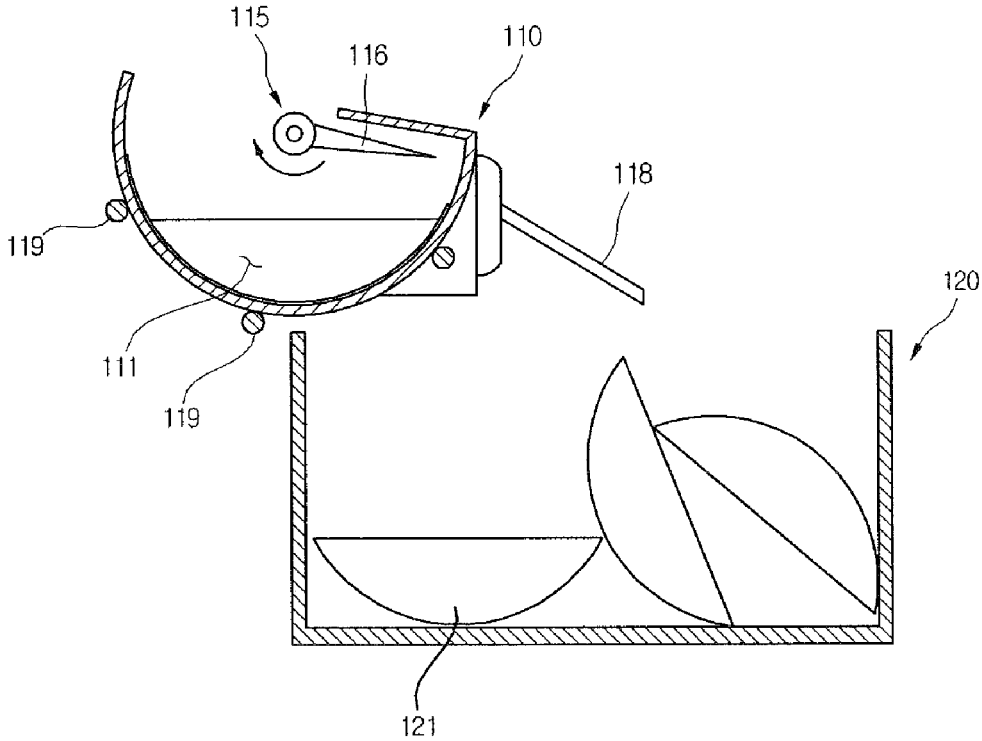
FIG. 7 is a sectional view of an icemaker and an ice bank of the refrigerator of FIG. 1.

Further, a heater 119 is disposed at the ice maker 110 to melt a surface of the ice made in the ice making chamber 111 (see FIG. 7). The heater 119 is disposed under the ice making chamber 111.

Figure 6:
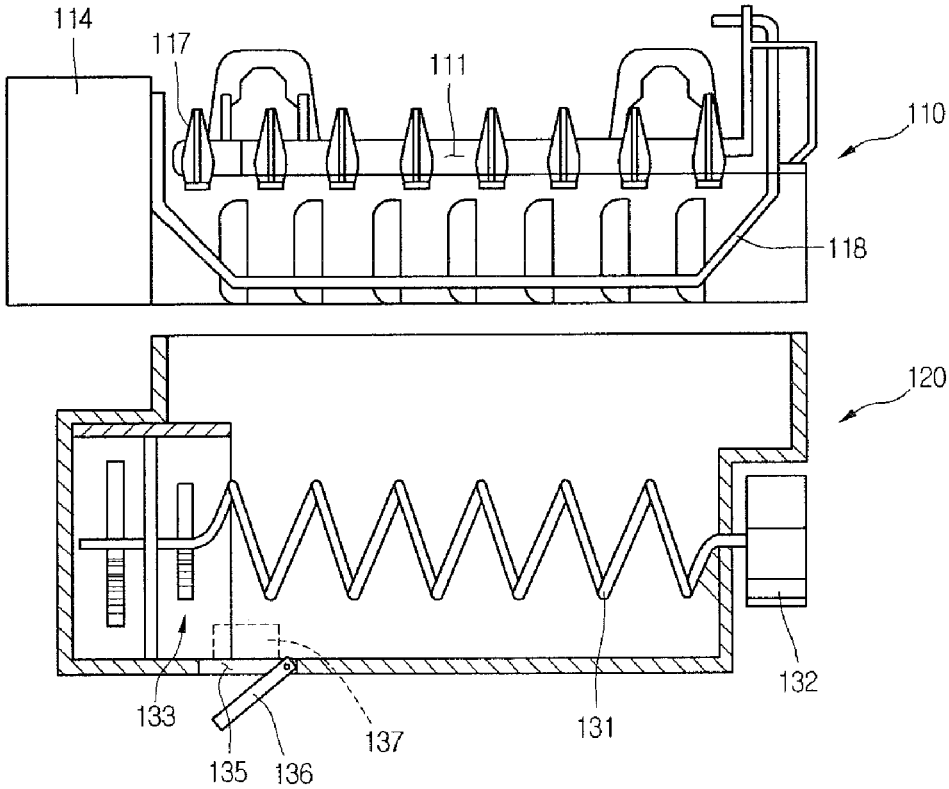
FIG. 6 is a sectional view of an icemaker and an ice bank of the refrigerator of FIG. 1.

FIG. 6 is a sectional view of the icemaker and an ice bank of the refrigerator of FIG. 1. Referring to FIG. 6, an ice bank 120 is disposed under the icemaker 110. The ice bank 120 has an opened top to receive the ice discharged from the icemaker 110.

An ice conveying unit 131 for conveying the ice to a side is disposed in the ice bank 120. The ice conveying unit 131 is formed in a spiral shape. A motor 132 is coupled to a side of the ice conveying unit 131. The motor 132 rotates the ice conveying unit 131.

An ice crusher 133 is coupled to the other side of the ice conveying unit 131 to crush the ice conveyed by the ice conveying unit 131. The ice crusher 133 includes a plurality of blades.

An ice outlet 135 is formed under the ice crusher 133 to discharge the ice conveyed by the ice conveying unit 131 to an ice dispenser 21. At this point, the ice outlet 135 is connected to an ice discharge duct (not shown) connected to the ice dispenser 21. A shutter 136 for opening and closing the ice outlet 135 is coupled to the ice outlet 135. The shutter 136 may actuated by a solenoid to open and close the ice outlet 135.

The following will describe operation of the ice making unit 100.

FIG. 7 is a sectional view of the icemaker and the ice bank of the refrigerator of FIG. 1. Referring to FIG. 7, water is supplied to the ice making chamber 111 through the water supply passage unit 70. The water supplied to the ice making chamber 111 is frozen into ice by cool air of the freezing compartment. When a control unit (not shown) determines that the water is frozen, the control unit operates the heater 119 to melt a surface of the ice. Next, the control unit operates the driving unit 114 to rotate the ejector 115, thereby discharging the ice into the ice bank 120. At this point, the ice full detecting lever 118 rotates downward together with the ejector 115 to measure a level of the ice filled in the ice bank 120. When the ice is caught by the ice full detecting lever 118, the control unit 120 determines that the ice bank 120 is fully filled with the ice and stops the ice making operation. However, when the ice is not caught by the ice full detecting lever 118, the control unit controls the water supply passage unit 70 to supply the water to the ice making chamber 111 to continuously make the ice.

Figure 8:
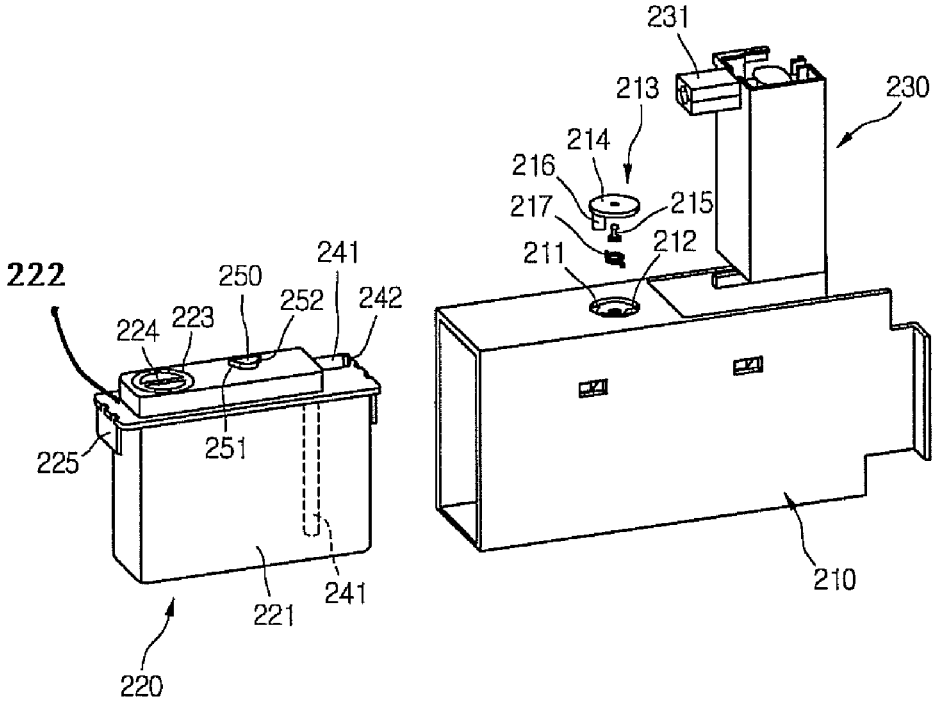
FIG. 8 is a perspective view of a water supply unit of the refrigerator of FIG. 1.

FIG. 8 is a perspective view of the water supply unit of the refrigerator of FIG. 1.

Figure 9:
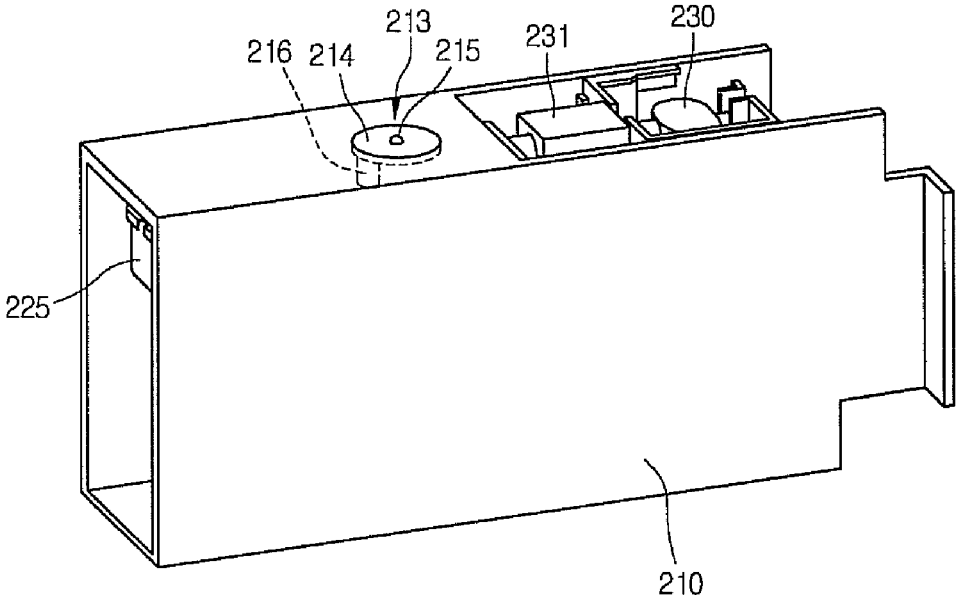
FIG. 9 is a perspective view illustrating a coupling state of the water supply unit of FIG. 8.

Referring to FIGS. 8 and 9, the water supply unit 200 includes a housing 210 coupled detachably to the refrigerating chamber 12, and a water tank 220 coupled detachably to the housing 210, a pump 230 for pumping out the water stored in the water tank 220 to the water supply passage unit 70. The water supply unit 200 may further include a coupling identifying unit for allowing the user to identify the stable coupling of the water tank 220 to the housing 210.

The water tank 220 may be formed in a box-shape that can be inserted into the housing 210. Since the water tank 220 is formed to correspond to the shape of the housing 210, the shape of the water tank 220 may vary in accordance with the shape of the housing 210.

The coupling identifying unit is disposed through the housing 210 and the water tank 220 to allow the user to identify the coupling state of the housing 210 and the water tank 220. A light emitting diode, which emits light when the water tank is securely coupled to the housing or a sound generating device, which generates sound, may be used as the coupling identifying unit. Alternatively, a mechanical structure that allows the user to sensually identify the coupling state of the water tank and the housing may be applied as the coupling state identifying unit. The following will describe a case where the mechanical structure is used as the coupling state identifying unit by way of example. The water tank 220 includes a water tank body 221 having an opened top and a cover 222 for opening/closing the opened top of the water tank body 221.

Locking levers 225 for fixing the cover on an upper portion of the water tank 220 may be provided on both sides of the cover 222. As the locking levers 225 rotate downward, the cover 222 is fixed on the water tank 220 to maintain the sealing property and coupling force of the cover 222 to the water tank body 221.

At this point, after the cover 222 is separated from the water tank body 221, the inside of the water tank 220 can be cleaned. Therefore, the inside of the water tank 220 can be hygienically maintained. Needless to say, the cover 222 may be integrally formed with the water tank body 221.

A water outlet 241 is formed inside the water tank 220. A top portion of the water outlet 241 is disposed on a top surface of the cover 222. An insertion portion 242 is formed on an end of the water outlet 241.

A water supply hole 223 through which the water is supplied into the water tank 220 is formed on an upper portion of the cover 222. A lid 224 is coupled to the water supply hole 223. At this point, the lid 224 and the water supply hole 223 are provided with threads so that the lid 224 can be coupled to the water supply hole 223 through a screw motion.

A catching unit 250 is formed on an upper portion of the cover 222. The catching unit 250 is formed in a cam shape. That is, the catching unit 250 has a first cam surface 251 and a second cam surface 252 that are arranged in parallel with a direction in which the water tank 220 is coupled to the housing 210. The first and second cam surfaces 251 and 252 are symmetric with each other.

A locking unit 213 is disposed on an upper portion of the housing 210. The locking unit 213 includes a disk 214 rotatably installed on the housing 210 and a catching projection 216 protruding from the disk 214. The locking unit 213 may further include an elastic member 217 biasing the disk 214 to an initial position. The structure of the locking unit will be described in more detail later.

The catching unit 250 of the cover 222 and the locking unit 213 of the housing 210 form the coupling state identifying unit. The coupling state identifying unit 250, 213 allows the user to identify the coupling or decoupling state by a touch feel when the water tank 220 is being coupled to the housing 210.

An installation groove 211 is formed on an upper portion of the housing 210. The installation groove 211 may be formed in a circular shape. An arc-shaped guide hole 212 is formed through the installation groove 211.

The disk 214 is rotatably coupled to the installation groove 211. A pin 215 is coupled to a center of the disk 214 so that the disk 214 rotates about the pint 215. The catching projection 216 that is movable inserted in the guide hole 212 is formed on the disk 214.

In addition, the elastic member 217 biases the disk 214 toward the initial position. At this point, a first end of the elastic member 217 is fixed on the disk 214 and a second end of the elastic member 217 is fixed on the installation groove 211. A torsion spring may be used as the elastic member 217.

Therefore, when the water tank 220 is coupled to the housing 210, the second cam surface 252 of the catching unit 250 presses the catching projection 216 and thus the disk 214 rotates. Further, when the catching projection 216 goes over the second cam surface 252 while sliding along the second cam surface 252, the catching unit 250 is returned to the initial position by the elastic member 217. This will be described in more detail later.

Meanwhile, the cam-shaped catching unit 250 may be disposed on an under surface of the upper portion of the housing 210 and the water tank 220 may be disposed on the cover 222.

The pump 230 may be coupled to the housing 210. At this point, the housing 210 may be partly opened at the top so as to receive the pump 230.

The pump 230 communicates with the water tank 220 when the water tank 220 is coupled to the housing 210. For example, a coupling portion 231 may be formed on the pump 230 so that the water outlet 241 of the water tank 220 is coupled to the coupling portion 231 when the water tank 220 is coupled to the housing 210 (see FIG. 9). At this point, the coupling portion 231 is provided with a structure that can be closely coupled to the insertion portion 242 formed on the end of the water outlet 241.

The following will describe a coupling process of the water supply unit 200.

Figure 10:
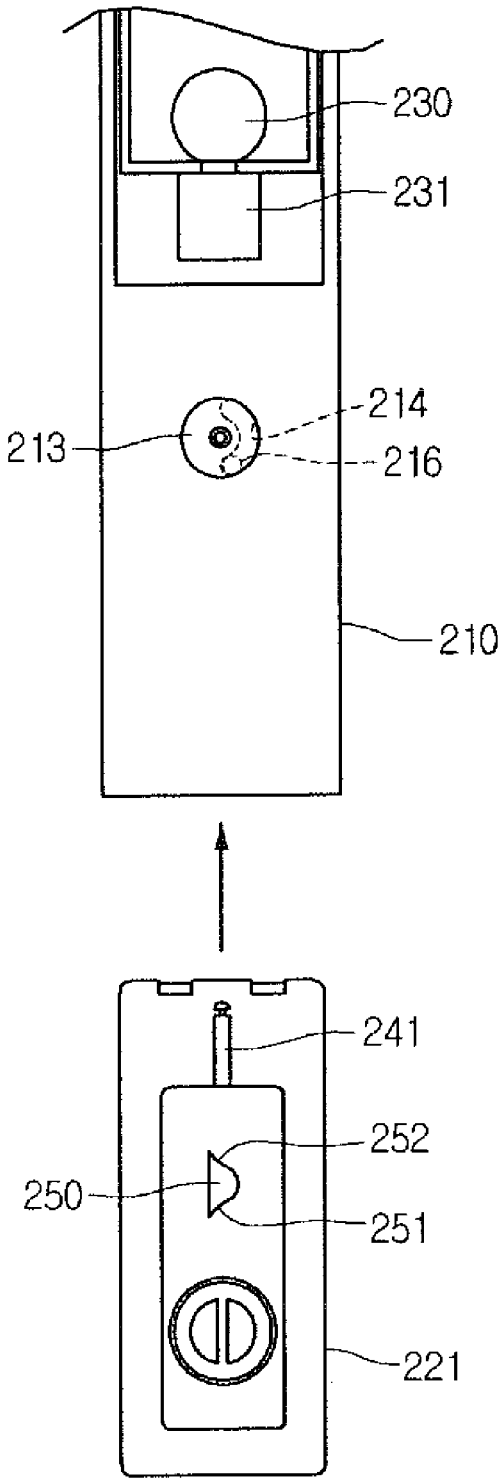
FIGS. 10 to 13 are detailed views illustrating a coupling process of the water supply unit of FIG. 8.

FIGS. 10 to 13 are detailed views illustrating a coupling process of the water supply unit. FIGS. 10 to 13 show a state before the water tank 220 is coupled to the housing 210. Referring to FIG. 10, the catching projection 216 is inserted into an insertion side of the water tank 220 at the guide hole 212 before the water tank 220 is coupled to the housing 210.

Figure 11:
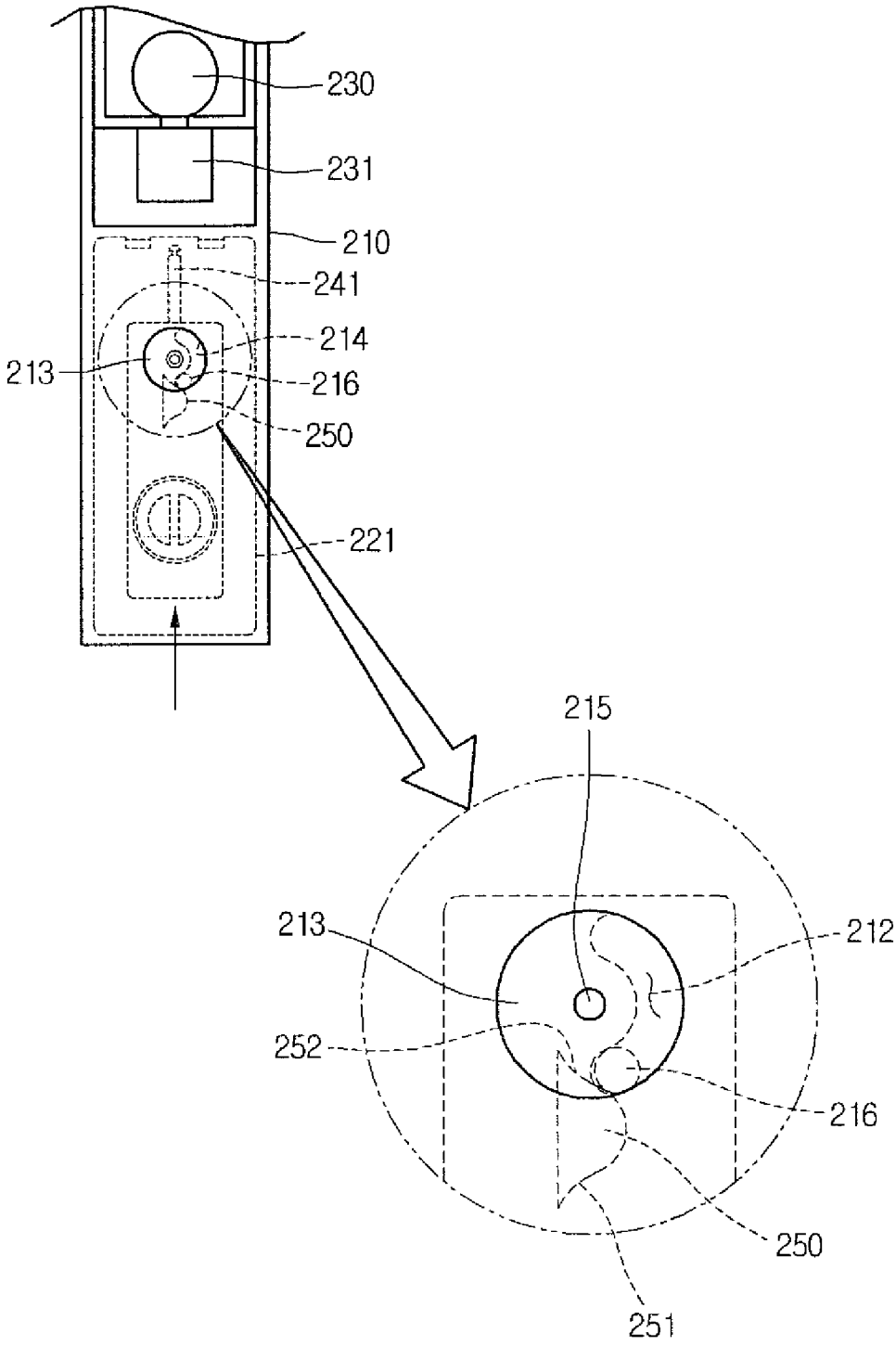

Referring to FIG. 11, when the water tank 220 is inserted in the housing 210 by a predetermined depth, the second cam surface 252 of the catching unit 250 presses the catching projection 216.

Figure 12:
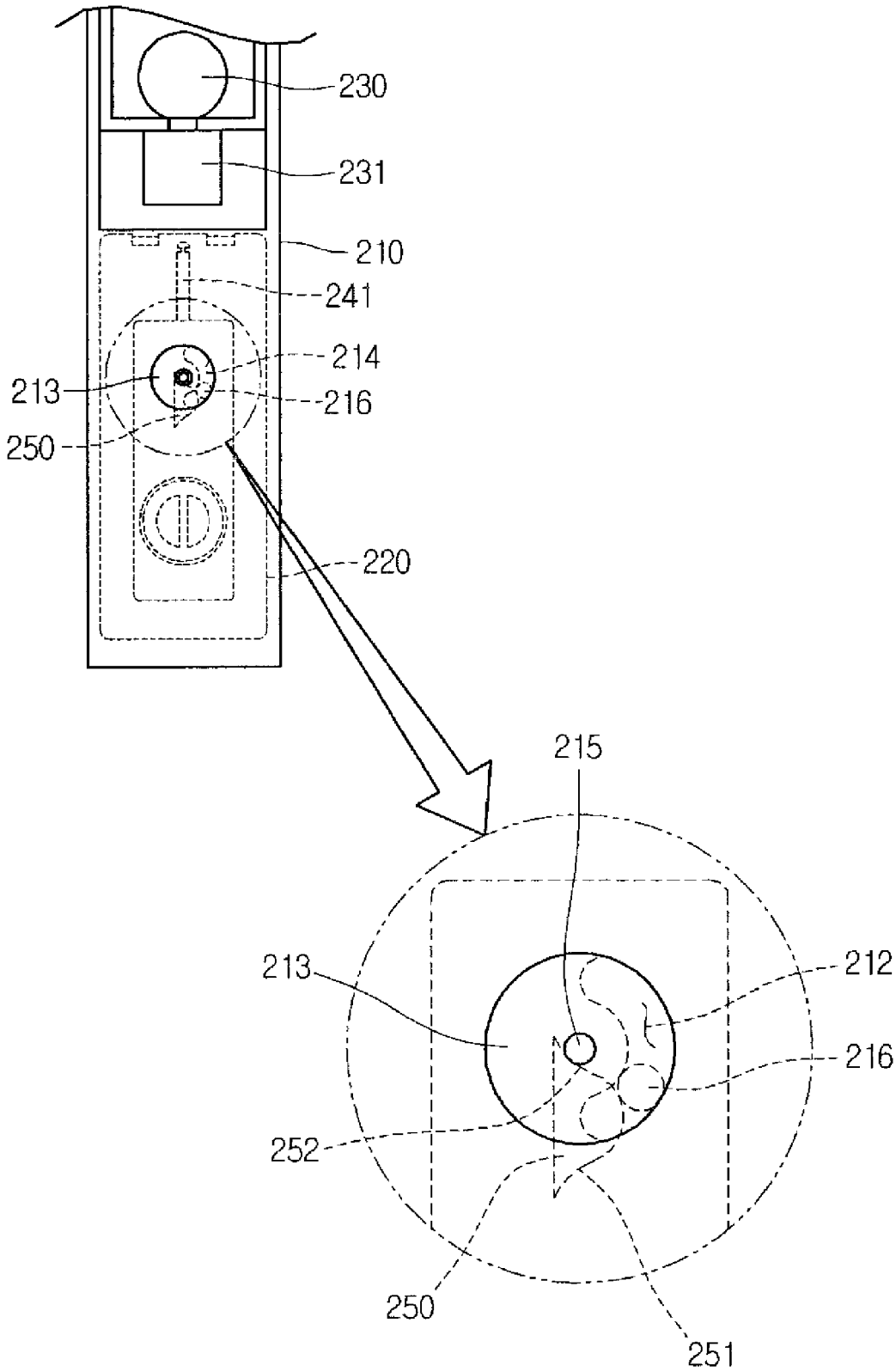

Referring to FIG. 12, when the water tank 220 is further inserted into the housing 210, the catching projection 216 moves while sliding along the second cam surface 252 of the catching unit 250. As the catching projection 216 moves and thus the disk 214 rotates about the pin 215 (rotates counter-clockwise). At this point, the user can feel that the restoring force of the spring and thus identify that the water tank 220 is almost inserted into the housing 210. When the water tank 252 is further inserted, the catching projection 216 reaches a convex portion that is a center of the second and first cam surfaces 252 and 251 of the catching unit 250.

At this point, since the disk 214 is biased by the elastic member 217, the disk 214 rotates in a direction (a clockwise direction) opposite to a direction in which the disk 214 rotates when the catching projection 216 is pressed. At the same time, as the disk 214 rotates in the opposite direction, the catching projection 216 moves while sliding along the first cam surface 251 of the catching unit 250.

Figure 13:
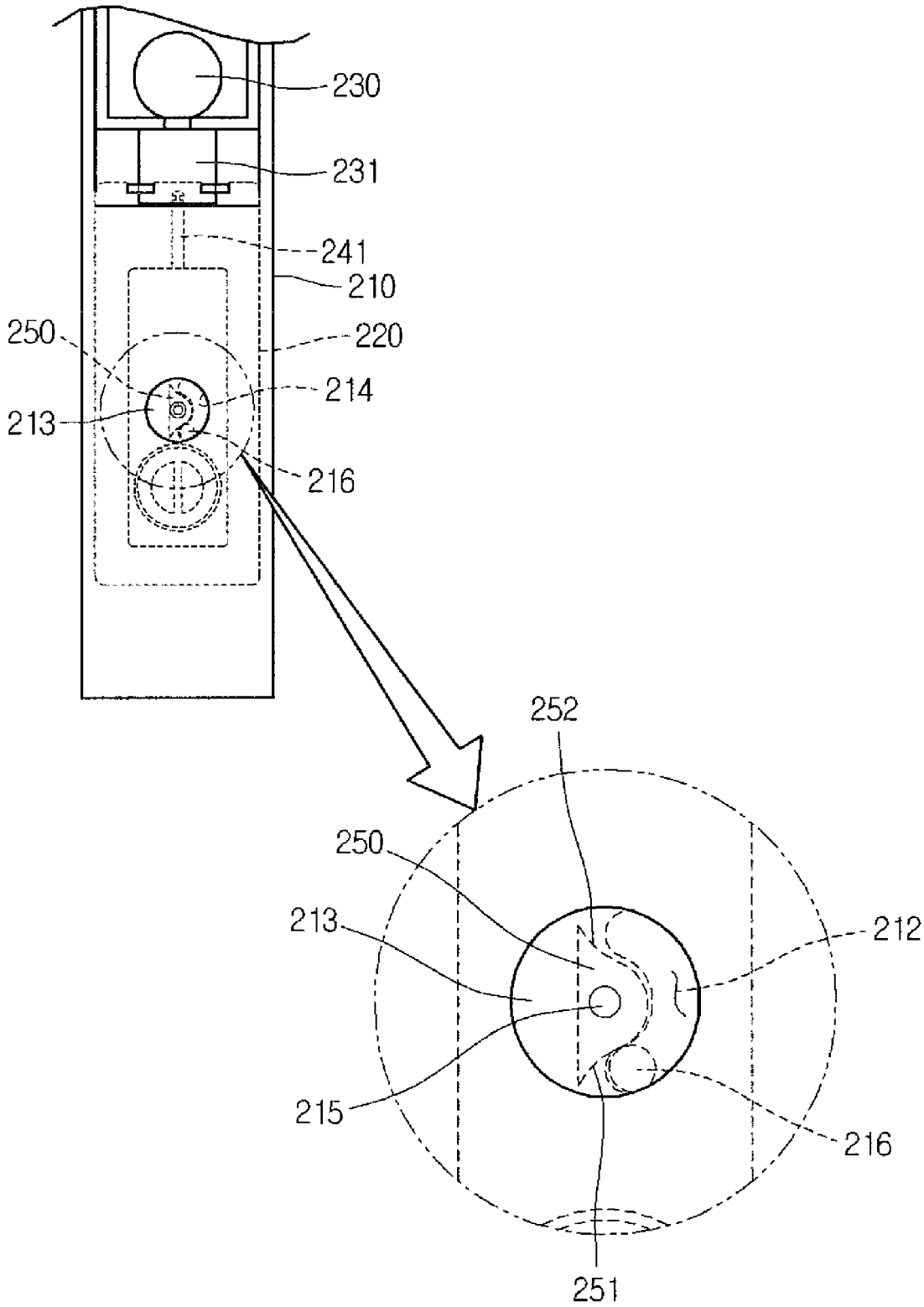

Referring to FIG. 13, when the water tank 220 is fully inserted into the housing 210, the catching projection 216 is returned to the initial position while sliding along the first cam surface 251 of the catching unit 250.

At this point, when the catching projection 216 slides along the first cam surface 251 of the catching unit 250, the biasing force of the elastic member 217 aids the pushing force inserting the water tank 220. Therefore, the user can feel that the water tank 220 is fully inserted.

At the same time, the insertion portion 242 of the water tank 220 is inserted into the coupling portion 231 of the pump 230. Therefore, the inside of the water tank 220 communicates with the pump 230 and thus the water stored in the water tank 220 is supplied to the icemaker 110 through the water supply passage unit 70 as the pump operates.

In addition, since the catching projection 216 restricts the first cam surface 251 of the catching unit 250, the water outlet pipe of the water tank 220 is not removed from the coupling portion 231 of the pump 230 even when opening/closing impact of the door 20 is transmitted to the water tank 220.

Meanwhile, when the water tank 220 is removed from the housing 210, the catching unit 250 and the locking unit 213 operates in an opposite order to the above. Therefore, a detailed description thereof will be omitted herein. In addition, when the water tank 220 is removed from the housing 210, the water outlet pipe of the water tank 220 will be removed from the coupling portion 231 of the pump 230.

The following will describe another embodiment of the refrigerator.

Figure 14:
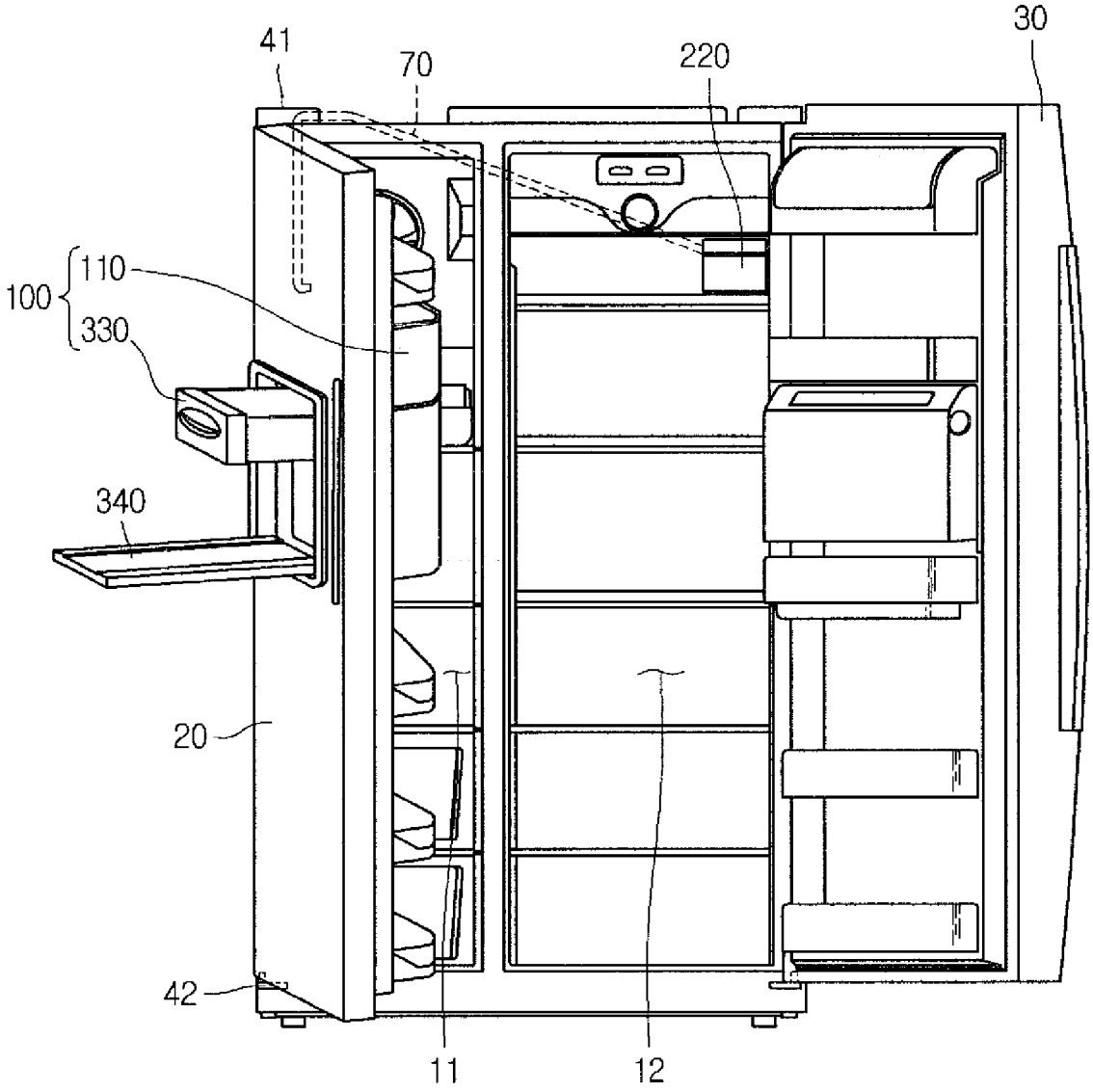
FIG. 14 is a front view of a refrigerator according to another embodiment.

FIG. 14 is a front view of a refrigerator according to another embodiment.

Referring to FIG. 14, a water supply unit 200 is disposed in the storage chamber. An ice making unit 100 is disposed on the door 20 for the freezing compartment. The water supply passage unit 70 is arranged at an outer side of the main body 10. Since an installation structure of the waters supply passage unit 70 is identical to that of the foregoing embodiment, a description thereof will be omitted herein.

The water supply passage unit 200 includes a water tank 220 and a pump 230. Since structures of the housing 210, water tank 220, and pump 230 are identical to those of the foregoing embodiment, description thereof will be omitted herein.

The ice making unit 100 includes an icemaker 110 and an ice bank 330 for storing ice discharged from the icemaker 110. Since a structure of the icemaker 110 is same as that of the foregoing embodiment, description thereof will be omitted herein.

The ice bank 330 is installed such that it can be taken out at the outer side of the door 20. At this point, an ice conveying unit, a motor, an ice crusher, and a shutter may be installed in the ice bank 330. Further, a handle 331 may be formed on the front portion of the ice bank 330 so that the user can pull the ice bank 330 using the handle 331. The ice bank 330 has an opened top through which the ice discharge from the icemaker 110 can be received.

A home bar door 340 may be disposed in front of the ice bank 330 so that the ice bank 330 cannot be exposed to the external side. A lower portion of the home bar door 340 is pivotally coupled by a hinge unit. Therefore, after opening the home bar door 340, the user can take the ice after drawing out the ice bank 330. After entering the ice bank 330, the user closes the home bar door 340.

INDUSTRIAL APPLICABILITY

According to the present invention, ice having a desired quality can be obtained. In addition, the freezing of the water supply passage unit supplying the water to the ice making unit can be prevented. Furthermore, the user can exactly identify if the water tank is accurately coupled or decoupled. Therefore, the industrial applicability of the present invention is very high.

The invention claimed is:

1. A refrigerator, comprising:

a main body having a freezing compartment and a refrigerating compartment formed therein;

freezing and refrigerating compartment doors coupled to the main body to respectively open and close the freezing and refrigerating compartments;

an ice making unit installed in the freezing compartment;

a water supply unit including a housing detachably coupled to the refrigerating compartment, a water tank detachably coupled to the housing, and a pump detachably coupled to the water tank to pump water stored in the water tank;

a water supply passage unit arranged at an outer side of the main body and connected to the water supply unit and the ice making unit to supply water pumped by the water supply unit to the ice making unit;

a cam type catching unit provided on one of the housing or the water tank; and a locking unit provided on the other of the housing or the water tank to engage the catching unit and couple the water tank to the housing, wherein the locking unit is configured to engage a first portion of the catching unit after being pushed by a second portion of the catching unit and returned to an initial position when the water tank is coupled to the housing, wherein the locking unit comprises:

a rotatable disk; and a catching projection protruding from the disk, wherein the catching projection engages the first portion of the catching unit after being pressed by the second portion of the catching unit and restored to the initial position, wherein the water tank is slidably inserted into the housing in a first direction and the catching unit is arranged on the one of the housing or the water tank so as to extend in a second direction that is perpendicular to the first direction, and wherein the first portion of the catching unit smoothly transitions into the second portion of the catching unit, and the first and second portions of the catching unit are substantially symmetrical to each other.

2. The refrigerator according to claim 1, further comprising an elastic member for biasing the disk to the initial position.

3. The refrigerator according to claim 2, further comprising a guide hole formed in the other of the housing or the water tank for guiding the movement of the catching projection.

4. The refrigerator according to claim 1, wherein the pump communicates with the water tank when the water tank is coupled to the housing.

5. The refrigerator according to claim 4, wherein the water tank includes a water outlet through which water is discharged, and the pump includes a coupling portion that is coupled to the water outlet of the water tank when the water tank is coupled to the housing.

6. The refrigerator according to claim 1, wherein the ice making unit is installed on the freezing compartment door.

7. The refrigerator according to claim 5, further comprising a hinge unit that couples the freezing compartment door to the main body, wherein the water supply passage unit is connected to the ice making unit via the hinge unit at the outer side of the main body.

8. The refrigerator according to claim 1, further comprising a groove formed in an outer surface of the main body to receive the water supply passage unit therein.

9. The refrigerator according to claim 6, wherein the ice making unit includes an ice making cavity and a water overflowing preventing unit for preventing the water from overflowing from the ice making cavity when the freezing and refrigerating compartment doors are opened and closed.

10. The refrigerator according to claim 6, wherein the ice making unit comprises:

an icemaker for making ice; and an ice bank that receives and stores ice discharged from the icemaker, wherein the ice bank is removably installed on the freezing compartment door such that the ice bank is removable from an outer side of the freezing compartment door.

11. The refrigerator according to claim 10, further comprising a home bar door installed outer side of the freezing compartment door, at a position corresponding to the ice making unit, so as to open and close an outer side of the ice bank.

* * * * *